United States Patent [19]

Dyess

[11] 4,045,028

[45] Aug. 30, 1977

[54] GAME TARGET WITH ADJUSTABLE PINS

[76] Inventor: Lonnie V. Dyess, 2644 Chestnut Drive, Grand Junction, Colo. 81501

[21] Appl. No.: 716,715

[22] Filed: Aug. 23, 1976

[51] Int. Cl.[2] ..... A63B 21/04

[52] U.S. Cl. ..... 273/104

[58] Field of Search ..... 273/95 R, 96 R, 96 B, 273/97 A, 100, 101, 102 R, 104, 105 R, 106 B, 106 C, 126 R, 127 R

[56] References Cited

U.S. PATENT DOCUMENTS

| | | | |
|---|---|---|---|
| 922,717 | 5/1909 | Parker | 273/105 R |
| 1,503,294 | 7/1924 | Bishop | 273/100 |
| 1,926,920 | 9/1933 | Smith | 273/100 X |
| 1,942,280 | 1/1934 | Fohman | 273/100 X |
| 2,472,719 | 6/1949 | Mysels | 273/105 R |
| 3,653,662 | 4/1972 | Welbourn | 273/105 R X |
| 3,815,915 | 6/1974 | Chapman | 273/105 R X |

FOREIGN PATENT DOCUMENTS

| | | | |
|---|---|---|---|
| 1,326,500 | 4/1963 | France | 273/97 A |

OTHER PUBLICATIONS

"Water Fun"; Argo Industries Corp.; Jackson Heights, N. Y.; Mar. 10, 1965.

*Primary Examiner*—Richard C. Pinkham
*Assistant Examiner*—Vance Y. Hum
*Attorney, Agent, or Firm*—Burton & Dorr

[57] ABSTRACT

A game in which hollow rings or horshoe shaped members are pitched or tossed by competitive players at erect pins of two similar game boards. The two similar game boards fit together for compact storage and transportation thereof. The game comprises a pair of members each having a generally planar playing surface, a plurality of pins associated with each playing surface, recesses formed on each of the playing surfaces for cooperating with the free ends of the pins for positioning said playing surfaces relative to each other in a predetermined manner when the playing surfaces are disposed in opposed, generally parallel relationship one to the other, and arms for securing together said members for compact storage and transportation of the game. Each pin includes first and second members, the first member of which is securely mounted to one of the playing surfaces and having a free end disposed outwardly from the playing surface, and the second member having a part thereof mounted for movement toward and away from the free end of the first member whereby the overall length or heighth of the pin may be increased when the game is being played and decreased when the game is assembled for storage or transportation. Each of the playing surfaces includes supports for positioning said playing surface at a predetermined angle of inclination relative to a support surface.

12 Claims, 8 Drawing Figures

GAME TARGET WITH ADJUSTABLE PINS

FIELD OF THE INVENTION

This invention relates to a game involving the use of hollow rings or horseshoe members and a pair of playing surfaces having pin means formed thereon.

BACKGROUND OF THE INVENTION

Many games have previously been proposed or used involving tossing or pitching hollow rings or horseshoe members on to pins. Moreover, prior art games have been constructed for compactness during storage and transportation. However, the known prior art games have been disadvantageous for one or more reasons. For example, some of the prior art games are entirely too large and bulky to be transported and easily used. Other prior art games have involved parts which are easily damaged or lost thereby rendering the game unusable. Other prior art games have been expensive to manufacture. Other prior art games have been disadvantageous because compactness for storage and transportation dictated the use of a relatively short pin means which is not satisfactory where the hollow rings or horseshoe members land with sufficient impact as to bounce upwardly sufficiently that same do not constitute a "score" according to the rules of the game. Other game boards have been found to be disadvantageous because of damage incurred during storage or transportation thereof when subjected to normal forces encountered under such conditions. Such damage often occurred from excessive stress concentrations imposed by the pin means formed on one of the playing surfaces upon the other playing surface. Other games have been disadvantageous since they did not include a simple and inexpensive means for inclining the playing surface at a predetermined angle of inclination relative to the surface upon which same was supported. Illustrative prior art games are shown, for example, in U.S. Pat. Nos. 915,450, 922,717, 1,543,767, 1,565,525, 1,942,280, 2,050,914, 2,265,517, 2,472,719 and 3,815,915.

SUMMARY OF THE INVENTION

This invention provides a new and novel game which is inexpensive to manufacture, may be easily and quickly assembled for storage and transportation and disassembled for use, and is not easily damaged or injured during use, storage or transportation.

It is a principal object of this invention to provide a unique and novel game in which hollow rings or horseshoes are tossed by competitive players at erect pin means of each of two similar game boards which are constructed for compact storage and transportation thereof.

It is another object of this invention to provide a game having playing surfaces each of which can be inclined at a predetermined angle of inclination relative to a surface upon which same are supported during use.

It is another object of this invention to provide a game comprising a pair of playing surfaces each of which has a plurality of pin means formed thereon, each of the pin means being adjustable in heighth to present a relatively high pin means during the time the game is being played and a relatively short pin means when the game is being stored or transported.

Another object of this invention is to provide a game including means for securing together the two playing surfaces of said game for compact storage and transportation thereof and, during use of the game boards, to support the game boards at a predetermined angle of inclination relative to a surface upon which same are supported.

Another object of this invention is to provide a game comprising a pair of members each having a generally planar playing surface, a plurality of pin means associated with each playing surface, each pin means including a first member having a longitudinal axis disposed generally perpendicular to said playing surface, each first member of said pin means having a free end disposed outwardly from said playing surface, each pin means being spaced apart one from the other, each of said pin means including a second member having a part thereof mounted for movement toward and away from the free end of the first member of said pin means, said second member having a longitudinal axis, said part of said second member being disposed, in one position of said second member, more distally from the playing surface than the free end of the first member of said pin means with a longitudinal axis of said second member being generally colinear with the longitudinal axis of said first member, means formed on each of said playing surfaces for cooperating with the free ends of the first member of the pin means of the other playing surface for positioning said playing surfaces relative to each other in a predetermined manner when said playing surfaces are disposed in opposed, generally parallel relationship one to the other, and means for securing together said members for compact storage and transportation of said game.

Another object of this invention is to provide a game as aforesaid in which each second member of each pin means, when said second member is disposed in said one position, is rigidly secured to the corresponding first member of said pin means to resist movement of said second member relative to said first member in a predetermined direction transverse to the longitudinal axis of said first member when said first member is subjected to a force in said predetermined direction.

Another object of this invention is to provide a game as aforesaid in which the second member of said pin means includes a sleeve element mounted in encompassing, frictional engagement about the first member of said pin means.

Another object of this invention is to provide a game as aforesaid in which the distance between the playing surface and each of the free ends of the first member of said pin means associated with said playing surface is substantially the same.

Another object of this invention is to provide a game as aforesaid in which said securing means includes a pair of arm members each pivotally mounted along one side of said playing surface and a pair of surface engaging means mounted along the opposite side of said playing surface, the pivotally mounted arms of each playing surface cooperating with the surface engaging means of the other playing surface to secure said playing surfaces in a spaced apart, opposed relationship one to the other when the free ends of the pin means of said playing surfaces are positioned by the positioning means of the other playing surface and the playing surfaces are disposed in said predetermined manner.

Another object of this invention is to provide a game as aforesaid in which the pair of pivotally mounted arms includes means for cooperatively engaging each other in a predetermined position of one of said arms relative to the other whereby said arms cooperate to support one side of said playing surface above the opposite side thereof to position said playing surface at a predetermined angle of inclination relative to a support surface upon which said playing surface is to be disposed when the game is set up for playing.

Another object of this invention is to provide a game as aforesaid in which said positioning means includes a plurality of recesses, each recess being disposed adjacent corresponding one of said pin means for receiving and maintaining therein a free end of one of said pin means for receiving and maintaining therein a free end of one of said pin means of the other playing surface when said playing surfaces are disposed in said predetermined manner.

Another object of this invention is to provide a game as aforesaid in which each of the free ends of the first members of said pin means are rounded off, and the free ends of the first members of said pin means and the recesses in which same are to be disposed are complementally formed to minimize the existence of stress concentrations between the free ends of the first members of said pin means and said recesses when the playing surfaces are disposed in opposed, generally parallel relationship one to the other.

Another object of this invention is to provide a game as aforesaid in which the first member of said pin means includes a hollow tubular portion having an inverted L-shaped slot formed through a part of the wall thereof, and the second member of said pin means includes a rod means disposed within said first member and having a boss portion formed on a portion of the surface thereof adjacent one end thereof and extending generally transversely to the longitudinal axis of said second member, said boss portion being disposed within said L-shaped slot of said first member, said boss portion and said L-shaped slot cooperating to control the amount of movement of said part of said second member toward and away from the free end of said first member.

Other objects and features of this invention will become apparent by reference to the following specification and to the drawings.

DESCRIPTION OF THE PREFERRED EMBODIMENTS

The game of this invention is constructed for compactness for storage and transportation. Each of the component parts of each playing surface are securely attached thereto to prevent inadvertent separation and loss therefrom. The pin means of each playing surface are constructed to be increased in heighth during playing of the game and decreased in heighth for storage and transportation. Each playing surface may be inclined at a predetermined angle of inclination when the game is being played.

Figure 1:
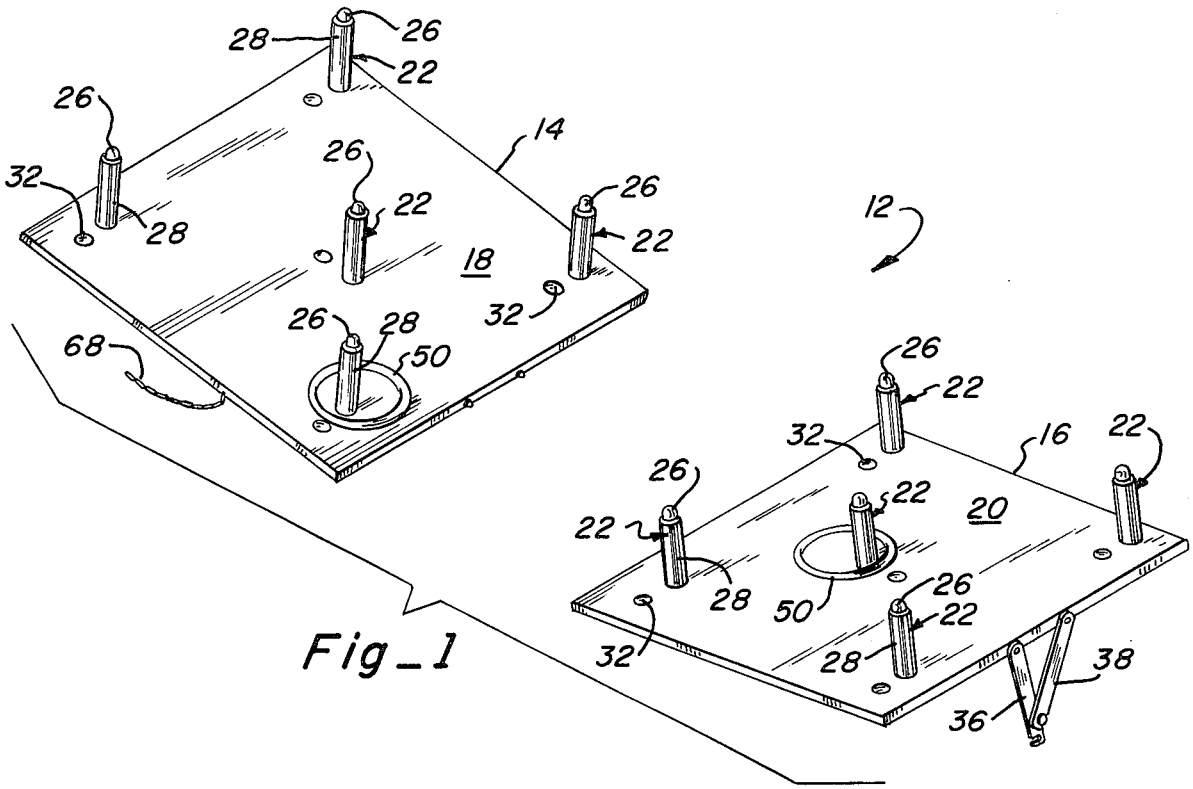
FIG. 1 is a perspective view of a preferred embodiment showing each of the playing surfaces set up at a predetermined angle of inclination when the game is ready to be played.
Figure 2:
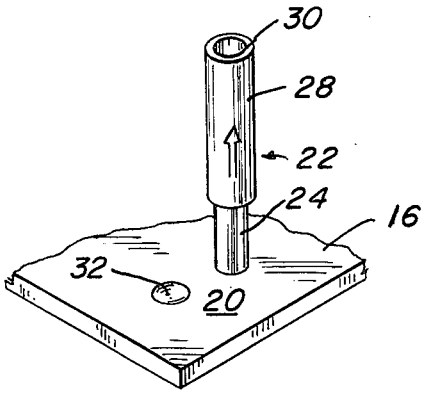
FIG. 2 is an enlarged view of a part of one of the playing surfaces shown in FIG. 1 and illustrating one position of the second member of the pin means in which a part of said second member is disposed more distally from the playing surface than the free end (not shown) of the first member of said pin means.

Referring now to the drawings and in particular to FIGS. 1–4 and 6–8, a game 12 is shown comprising a pair of members 14 and 16 each having a generally planar playing surface 18 and 20. The game 12 also comprises a plurality of pin means 22 associated with each playing surface. Each pin means 22 includes a first member 24 (see FIGS. 2 and 7) having a longitudinal axis disposed generally perpendicular to the playing surface. Each first member 24 of said pin means has a free end 26 disposed outwardly from the playing surface. Each pin means is spaced apart one from the other. Each pin means 22 includes a second member 28 having a part 30 (see FIG. 2) mounted for movement toward and away from the free end 26 of the first member 24 of the pin means. Each second member 28 also has a longitudinal axis which is disposed generally colinearly with a longitudinal axis of the first member, and the part 30 of the second member 28 is disposed, in one position of said second member, more distally from the playing surface than the free end 26 of the first member 24 (see FIG. 2). When the game is set up for playing, the first and second members of the pin means are normally disposed as shown in FIG. 2. The second member 28 of the pin means 22 includes a sleeve element that is adjustably mounted on the first member of said pin means in a direction parallel with the longitudinal axis of the first member of the pin means 22.

The game 12 also includes means 32 formed on each of the playing surfaces for cooperating with the free ends 26 of the first members 24 of the pin means 22 of the other playing surface for positioning said playing surfaces relative to each other in a predetermined manner when said playing surfaces are disposed in opposed, generally parallel relationship one to the other. The positioning means 32 includes a plurality of recesses. Each recess is disposed adjacent a corresponding one of said pin means 22. Each recess is adapted to receive and maintain therein a free end 26 of one of the pin means 22 of the other playing surface when said playing surfaces are disposed in said predetermined manner. It will be noted that the free end 26 of the first members 24 of the pin means 22 are rounded off or arcuately shaped to eliminate any sharp corners or edges. The positioning means 32 are complementally shaped to receive therein the rounded off free ends 26. The use of rounded off free ends 26 and complementally shaped positioning means or recesses 32 minimizes the existence of stress concentrations therebetween thereby reducing the change of damage or injury occuring to the playing surfaces.

The game 12 also includes means 34 (see FIG. 8) for securing together the members 14 and 16 for compact storage and transportation of the game. The securing means 34 includes a pair of arm members 36 and 38 each of which is pivotally mounted along one side of one of the playing surfaces and a pair of surface engaging means 40 (see FIG. 4) mounted along one of the sides of the other playing surface. The pivotally mounted arms 36 and 38 of each playing surface cooperate with the surface engaging means 40 of the other playing surface to secure said playing surfaces in a spaced apart, opposed relationship one to the other when the free ends of the pin means 22 of each of the playing surfaces are positioned by the positioning means 32 of the other playing surface and the playing surfaces are disposed in said predetermined manner.

Figure 7:
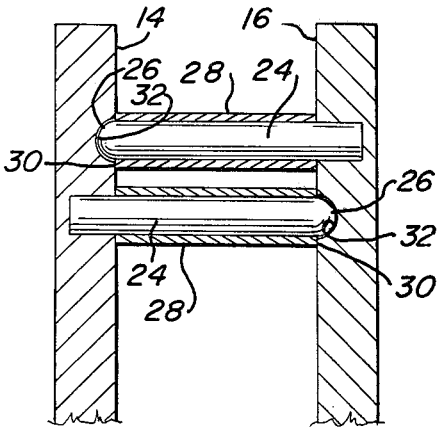
FIG. 7 is an enlarged view showing the relationship of the free ends of two first members of two pin means positioned within corresponding recesses.
Figure 8:
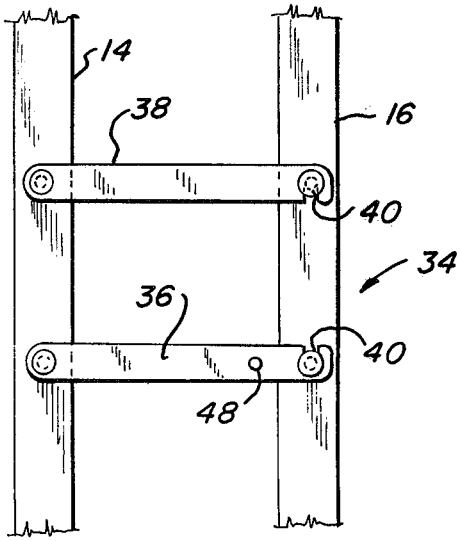
FIG. 8 is an enlarged view showing the means for securing together said members for compact storage and transportation of said game.

As shown in FIGS. 1 and 7, the second members 28 are shorter in length than that portion of the first member 24 which extends above the playing surface. The purpose of this is to permit the free ends 26 of the first members to be disposed within the means 32 of the other playing surface while keeping to a minimum the size of the means or recesses 32 and, also, where the length of the second members 28 are as shown in FIG. 7, to increase the overall rigidity of the game when same is assembled for storage or transportation.

Figure 3:
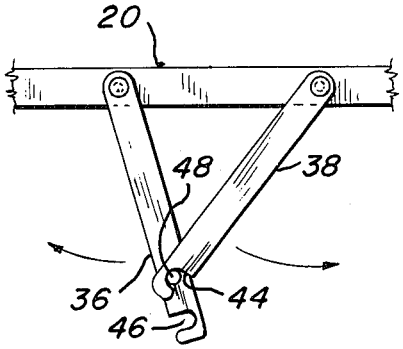
FIG. 3 is an enlarged view showing one position of the means for securing together said members for compact storage and transportation of the game whereby one side of said playing surface is supported above the opposite side thereof to position said playing surface at a predetermined angle of inclination relative to a support surface.

Referring now to FIGS. 1 and 3, it will be noted that the arms 36 and 38 includes means for cooperatively engaging each other in a predetermined position of one of said arms relative to the other whereby said arms cooperate to support one side of said playing surface above the opposite side thereof to position said playing surface at a predetermined angle of inclination (see FIG. 1) relative to a support surface (not shown) upon which said playing surface is to be disposed when the game is set up for playing. First of all, it will be noted that each of the arms 36 and 38 include, respectively, an opening 44 and 46 formed adjacent the free end thereof. Arm 36 additionally includes a surface engaging portion 48 (see FIG. 8) which is also formed adjacent the opening 46. As shown in FIG. 3, the opening 44 of arm 38 cooperates with the surface engaging portion 48 of arm 36, in one position of the arms 36 and 38, to support one side of the playing surface above the opposite side thereof, as shown in FIG. 1, thereby to support the playing surface at a predetermined angle of inclination relative to the surface upon which said playing surface is supported when the game is set up for playing.

Where hollow rings 50 are used in playing the game, it will be understood that it is preferable to support the playing surface at a predetermined angle of inclination in order to facilitate tossing the hollow ring 50 over one of the pin means 22. Depending upon the material from which the hollow rings 50 is made and/or the material used to form the playing surfaces 18 and 20, it has been found that under various conditions the hollow rings 50 will, upon impacting upon the playing surface, bounce upwardly from the playing surface and end up no longer "encircling" one of the pin means 22. It has been found that the use of a pin means comprising first and second members in which the first member is secured to the playing surface and the second member is adjustably mounted on the first member as described above will overcome this particular condition and, at the same time, provide a compact game for storage and transportation.

Figure 5:
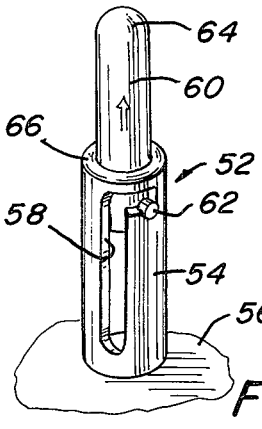
FIG. 5 is another embodiment of a pin means constructed in accordance with this invention.
Figure 4:
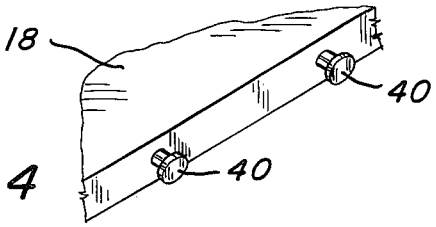
FIG. 4 is an enlarged view showing a pair of surface engaging means mounted along one side of the playing surface.

Referring now to FIG. 5, another embodiment of a pin means 52 is shown. Pin means 52 includes a hollow tubular portion 54 securely mounted to the playing surface 56. The hollow tubular five member 54 has an inverted L-shaped slot 58 formed through a part of the wall thereof. The pin means 52 also includes a second member 60 comprising a rod member that is mounted within the first member 54. The second member includes a boss portion 62 formed on a portion of the surface thereof adjacent one end thereof (the lower end as shown in FIG. 5) and extending generally transversely to the longitudinal axis of the second member 60. The boss portion 62 is disposed within the L-shaped slot 58 of the first member 54. The boss portion 62 and the L-shaped slot 58 cooperate with each other to control the amount of movement of the part 64 of the second member 60 toward and away from the free end 66 of the first member 54.

As shown in FIGS. 1 and 2, the second member 28 of the pin means 22 includes a sleeve element mounted in encompassing, frictional engagement about the first member 24. The second member 28 may be constructed from a tubular piece of rubber or plastic. The second member should, however, be sufficiently rigid when disposed in the position shown in FIG. 2 so as to resist movement thereof relative to the first member 24 in a predetermined direction transverse to the longitudinal axis of the first member 24 (in the direction in which the hollow ring or horseshoe travels toward the pin means) when the pin means is subjected to the impact force of the hollow ring 50 or horseshoe.

The distance between the playing surface and the free ends of the first part of said pin means associated with said playing surface is preferably the same for all pin means.

It will be understood that when the game is assembled for storage or transportation, the hollow rings 50 (the number used for the game may vary as desired) are mounted upon one or more of the pin means in order to prevent inadvertent separation and loss of the hollow rings 50 from the game.

In view of the foregoing, it will be understood that each of the recesses are formed adjacent a corresponding one of the pin means in order that the free ends of the pin means of one of the playing surfaces will be received and maintained within the recesses formed in the other playing surface.

Figure 6:
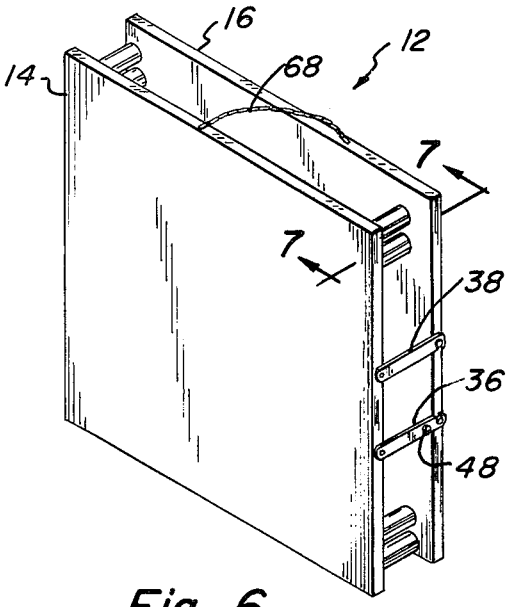
FIG. 6 is a perspective view showing the game in a compact assembled condition for storage or transportation.

As shown in FIG. 6, a flexible member 68 may be either securely or removably attached to one of the members 14 or 16 and removably attached to the other of said member whereby said flexible member 68 will function as a handle for the game 12.

In view of the foregoing, it will be readily appreciated that a unique and novel game has been disclosed and described herein. The game of this invention is not only inexpensive to manufacture but is extremely compact when assembled for storage or transportation. Additionally, the game is constructed in a manner that minimizes or eliminates inadvertent loss of parts therefrom which would render the game unuseable. Furthermore, the game overcomes the problem heretofore encountered with the hollow rings (which are usually made from a rubber-like material) bouncing off of the playing surface and out of encompassing engagement with the pin means. Since the game is compact in structure, when assembled, it is convenient to store and transport for use without taking up an undue amount of area in a vehicle when same is being transported for use. Rounding of the free ends of the first members and forming a complementally shaped recesses further reduces the occurrence of injury or damage to the game when same is being stored or transported.

Although different embodiments of this invention have been illustrated and described and variations thereof indicated, it will be understood that other embodiments may exist and that various changes may be made, all without departing from the spirit and scope of this invention.

I claim:

1. A game target comprising a. a pair of members each having a generally planar playing surface, b. a plurality of pin means associated with each playing surface i. each pin means including a first member having a longitudinal axis disposed generally perpendicular to said playing surface, each first member of said pin means having a free end disposed outwardly from said playing surface, each pin means being spaced apart one from the other, ii. each of said pin means including a second member having a pair thereof mounted for movement toward and away from the free end of the first member of said pin means, said second member having a longitudinal axis, said part of said second member being disposed in one position of said second member, more distally from the playing surface than the free end of the first member of said pin means with the longitudinal axis of said second member being generally colinear with the longitudinal axis of said first member, each second member including a sleeve element adjustably mounted on the first member of said pin means in a direction parallel with the longitudinal axis of the first member of said pin means, c. means formed on each of said playing surfaces for cooperating with the free ends of the first member of the pin means of the other playing surface for positioning said playing surfaces relative to each other in a predetermined manner when said playing surfaces are disposed in opposed, generally parallel relationship one to the other, said positioning means including a plurality of recesses, each recess being disposed adjacent a corresponding one of said pin means, each recess being adapted to receive and maintain therein a free end of one of the pin means of the other playing surface when said surfaces are disposed in said predetermined manner, and d. means for securing together said members for compact storage and transportation of said game, said securing means including a pair of arm members each pivotally mounted along one side of said playing surface and a pair of surface engaging means mounted along the opposite side of said playing surface, the pivotally mounted arms of each playing surface cooperating with the surface engaging means of the other playing surface to secure said playing surfaces in a spaced apart, opposed relationship one to the other when the free ends of the pin means of each of said playing surfaces are positioned by the positioning means of the other playing surface and the playing surfaces are disposed in said predetermined manner.

2. A game as described in claim 1 in which the pair of pivotally mounted arms includes means for cooperatively engaging each other in a predetermined position of one of said arms relative to the other whereby said arms cooperate to support one side of said playing surface above the opposite side thereof to position said playing surface of a predetermined angle of inclination relative to a support surface upon which said playing surface is to be disposed when the game is set up for playing.

3. A game as described in claim 1 in which the distance between the playing surface and the free ends of the first part of said pin means associated with said playing surface is substantially the same.

4. A game target comprising a. a pair of members each having a generally planar playing surface, b. a plurality of pin means associated with each playing surface, i. each pin means including a first member having a longitudinal axis disposed generally perpendicular to said playing surface, each first member of said pin means having a free end disposed outwardly from said playing surface, each pin means being spaced apart one from the other, ii. each of said pin means including a second member having a part thereof mounted for movement toward and away from the free end of the first member of said pin means, said second member having a longitudinal axis, said part of said second member being disposed, in one position of said second member, more distally from the playing surface than the free end of the first member of said pin means with a longitudinal axis of said second member being generally colinear with the longitudinal axis of said first member, c. means formed on each of said playing surfaces for cooperating with the free ends of the first member of the pin means of the other playing surface for positioning said playing surfaces relative to each other in a predetermined manner when said playing surfaces are disposed in opposed, generally parallel relationship one to the other, and d. means for securing together said members for compact storage and transportation of said game.

5. A game as described in claim 4 in which each second member of each pin means, when said second member is disposed in said one position, is rigidly secured to the corresponding first member of said pin means to resist movement of said second member relative to said first member in a predetermined direction transverse to the longitudinal axis of said first member when said first member is subjected to a force in said predetermined direction.

6. A game as described in claim 5 in which the first member of said pin means includes a hollow tubular portion having an inverted L-shaped slot formed through a part of the wall thereof, and the second member of said pin means includes a rod member disposed within said first member and having a boss portion formed on a portion of the surface thereof adjacent one end thereof and extending generally transversely to the longitudinal axis of said second member, said boss portion being disposed within said L-shaped slot of said first member, said boss portion and said L-shaped slot cooperating to control the amount of movement of said part of said second member toward and away from the free end of said first member.

7. A game as described in claim 4 in which the second members of said pin means include a sleeve element mounted in encompassing, frictional engagement about the first member of said pin means.

8. A game as described in claim 4 in which the distance between the playing surface and each of the free ends of the first member of said pin means associated with said playing furface is substantially the same.

9. A game as described in claim 4 in which said securing means includes a pair of arm members each pivotally mounted along one side of said playing surface and a pair of surface engaging means mounted along the opposite side of said playing surface, the pivotally mounted arms of each playing surface cooperating with the surface engaging means of the other playing surface to secure said playing surfaces in a spaced apart, opposed relationship one to the other when the free ends of the pin means of said playing surfaces are positioned by the positioning means of the other playing surface and the playing surfaces are disposed in said predetermined manner.

10. A game as described in claim 9 in which the pair of pivotally mounted arms includes means for cooperatively engaging each other in a predetermined position of one of said arms relative to the other whereby said arms cooperate to support one side of said playing surface above the opposite side thereof to position said playing surface at a predetermined angle of inclination relative to a support surface upon which said playing surface is to be disposed when the game is set up for playing.

11. A game as described in claim 4 in which said positioning means includes a plurality of recesses, each recess being disposed adjacent a corresponding one of said pin means for receiving and maintaining therein a free end of one of the pin means of the other playing surface when said surfaces are disposed in said predetermined manner.

12. A game as described in claim 11 in which each of the free ends of the first members of said pin means are rounded off, and the free ends of the first members of said pin means and the recesses in which same are to be disposed are complementally formed to minimize the existence of stress concentrations between the free ends of the first members of said pin means and said recesses when the playing surfaces are disposed in opposed, generally parallel relationship one to the other.

* * * * *